United States Patent [19]

Simpson

[11] Patent Number: 4,606,728

[45] Date of Patent: Aug. 19, 1986

[54] WATER SKI AID

[76] Inventor: James D. Simpson, 38981 Harris Rd., Yucaipa, Calif. 92399

[21] Appl. No.: 700,094

[22] Filed: Feb. 11, 1985

[51] Int. Cl.[4] ..... A63C 15/00

[52] U.S. Cl. ..... 441/66; 441/130; 297/464

[58] Field of Search ..... 441/65, 66, 68, 72, 441/73, 129, 130, 132; 114/253, 254; 297/464, 469, 488, DIG. 3; 434/253

[56] References Cited

U.S. PATENT DOCUMENTS 3,358,304 12/1967 Ensmay ..... 441/65

3,740,095 6/1973 Nail ..... 441/130 X 3,860,976 1/1975 Suyama ..... 297/DIG. 3 X 4,028,761 6/1977 Taylor ..... 441/65

*Primary Examiner*—Sherman D. Basinger

*Assistant Examiner*—Paul E. Salmon

*Attorney, Agent, or Firm*—Harvey S. Hertz

[57] ABSTRACT

A water ski aid for supporting a water skier includes an inflatable seat member. A pair of inflatable arms is used to secure the skier to the inflatable seat member. The free ends of the arms overlap the body of the skier when in a secure position in the seat member. The arms separate when the skier gains sufficient speed to overcome the drag of the inflatable seat member.

4 Claims, 4 Drawing Figures

FIG. 1
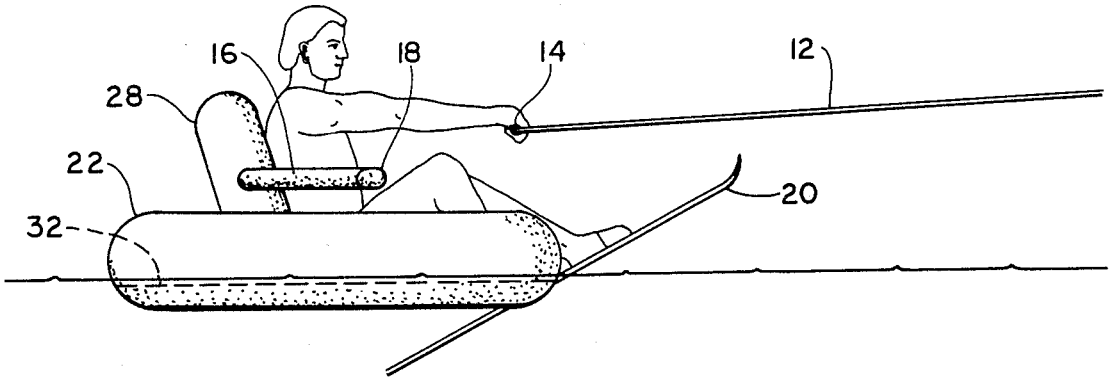
FIG. 2
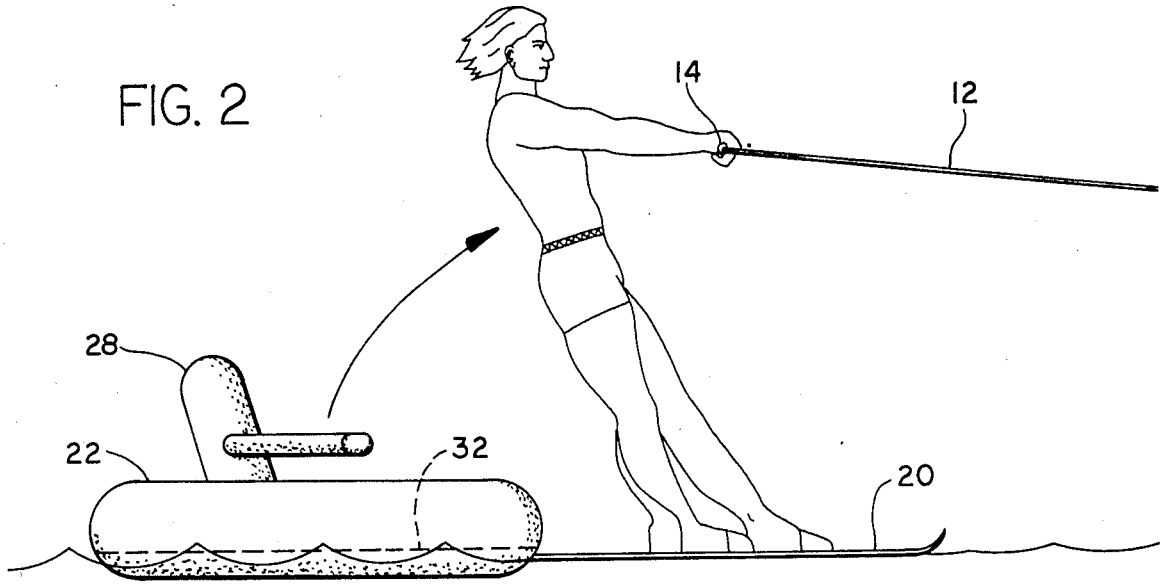
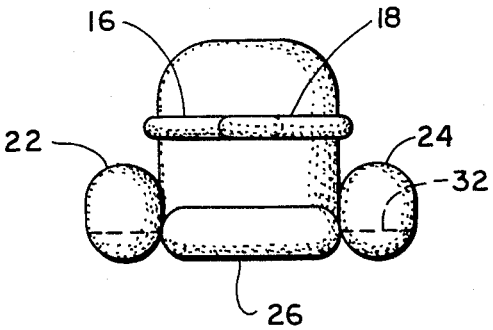
FIG. 3
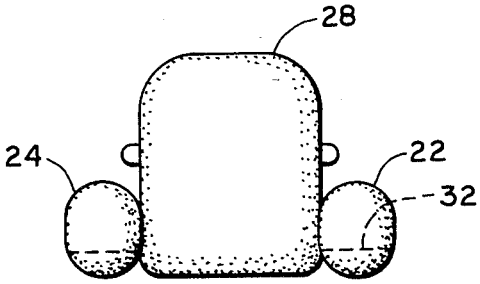
FIG. 4

WATER SKI AID

BACKGROUND OF THE INVENTION (1) Field of the Invention

The invention relates to water skiing aids generally, and, more particularly, to an inflatable support seat for supporting a water skier.

(2) Description of the Prior Art

Conventional prior art water flotation devices are utilized for safety when teaching a person to swim or for relaxation in a swimming pool or other body of water. The conventional bath floating device allows a person to sit or lie on the device.

A typical device is shown in U.S. Pat. No. 3,860,976 wherein a pillow is provided on an annular float. A back sheet provides central support, and a pair of arms holds the bather's body.

Other known water support devices include U.S. Pat. Nos. 4,236,264; 3,740,095; 3,088,139; 2,717,400; 1,465,790; 2,980,927 and Design Patent No. 187,313.

While each of these patents provide some flotation support for a bather, none are useful wherein it is desirable to support a water skier prior to the time that he rises onto the water skis and is no longer in need of a support. Typically, such a situation arises with a novice water skier who has just learned to ski or is skiing for the first time.

The manner in which the invention addresses the disadvantages of the prior art to provide a novel and highly advantageous water ski aid will be understood as this description proceeds.

SUMMARY OF THE INVENTION

The present invention generally provides a water ski aid for use by a novice water skier enabling him to be supported prior to the initial standing on the water skis.

The water ski aid includes an inflatable seat member. A pair of inflatable arms is secured to the skier enabling the skier to be secured to the inflatable seat member. The free ends of the arms overlap the body of the skier when in a secure position in the seat member. The arms separate when the skier has gained sufficient speed to overcome the drag of the inflatable seat.

BRIEF DESCRIPTION OF THE DRAWINGS

FIG. 1 is a perspective view illustrating a skier positioned in the water ski aid;

FIG. 2 illustrates the skier as he commences to lift off onto the water skis;

FIG. 3 is a front plan view of the ski aid; and

FIG. 4 is a rear plan view of the ski aid.

DETAILED DESCRIPTION

Referring now to the drawings, there is shown in FIG. 1, a water ski aid constructed in accordance with principles of the invention. Typically, the water ski aid includes a skier who is seated in the water ski aid and is being pulled by a boat (not shown) via a rope 12 attached to the boat at one end and to a hand-held stick 14 held by the skier at its other end. Initially, the skier remains seated in the seat and is held therein by a pair of inflatable arms 16, 18 which overlap at their free ends around the chest of the water skier. Typically, the arms can be secured to each other by means of a velcro hook and pile arrangement (not shown).

As the boat pulling the skier builds up sufficient speed, the skier can change from a seated position of FIG. 1 to a conventional, vertical skiing position as shown in FIG. 2. As the boat speed increases and the skier overcomes the drag of the water skiing aid, the arms 16 and 18 tend to separate as he leaves the aid behind and moves to a conventional water skiing position of FIG. 2. At this point, the skier is supported by the water skis 20.

The water ski aid, as shown in FIG. 3 includes a pair of horiizontal side supports 22 and 24, also made typically of vinyl and which are air inflatable through valves (not shown). The side supports are normally elongated in shape and of sufficient length and height to aid in support of an average person. The side supports 22 and 24 are interconnected by a seat 26 and a back 28. The seat 26 and back 28 can be of one-piece construction in generally an L-shaped configuration. Normally, the seat 26 and back 28 also are made of inflatable vinyl and are sewn to the adjacent surfaces of the horizontal side supports 22 and 24 along the horizontal axis of the seat and the vertical axis of the back. Alternatively, it should be understood that the seat 26 and the back 28 could be made of two separate parts, each having separate inflation valves.

The inflatable arms 16 and 18 are each secured at one end respectively, to the side wall of the back 18 and overlap so as to secure around the wearer's chest, as shown in FIG. 1. These arms are also, as previously pointed out, made of vinyl and inflatable.

It has been found that inflatable vinyl is the most satisfactory material considering cost, ease of inflation, and the minimizing of danger should there be an accident utilizing the water skier aid. However, it should be understood that other type materials could be used.

The dotted line 32 shown in the horizontal side supports 22 and 24 are used to indicate a water or sand ballast line contained in the horizontal side supports and possibly the seat portion as well. The water or sand ballast adds stability to the skiing aid, thus stabilizing and minimizing overturning of the aid.

The inflatable arms 16 and 18, the horizontal supports 22 and 24, the seat 26 and the back 28 are all normally made of induvidual air-inflated vinyl modules, each having its own air-inflated valve. The modules are normally sewn or otherwise secured together by conventional techniques such as by cementing or heat sealing. Alternatively, certain of the modules such as the seat 16 and the back 28 could be formed of a single individual unit.

It should be understood that the device as illustrated would normally come in more than one size and could be designed to be compatible with the height and weight of the user.

I claim:

1. A water ski aid for supporting a water skier comprising:

an inflatable seat member; and a pair of inflatable arm members having free ends for securing the skier to the inflatable seat member, the free ends of said arm members overlapping the chest area and body of said skier when said skier is in said secure position in said seat member, said arm members having means to secure said free ends together, said free ends being secured to each other when said skier is secured in said inflatable seat member and said skier and said water ski aid are moving at relatively slow speeds, said free ends separating when said skier gains sufficient speed to overcome the drag of said inflatable water ski aid and said skier moves from a seated position to a standing ski position enabling the skier to be released from said water ski aid.

2. Apparatus in accordance with claim 1 wherein said free ends of said inflatable arm members are connected together by means of a velcro hook and pile arrangememt.

3. Apparatus in accordance with claim 1 and further comprising a pair of individual side members positioned on either side of said seat member, and a back member connected to said seat member and positioned between said side members.

4. Apparatus in accordance with claim 1 wherein each of said members are individual air-inflatable modules, said modules being secured together and each having their own air valves.

* * * * *